US009415957B2

(12) United States Patent
Fuda et al.

(10) Patent No.: US 9,415,957 B2
(45) Date of Patent: Aug. 16, 2016

(54) SHEET FEED DEVICE AND IMAGE FORMING APPARATUS

(71) Applicants: Munehisa Fuda, Kanagawa (JP); Takaya Ochiai, Kanagawa (JP); Kazuki Seto, Kanagawa (JP); Shinji Katsumata, Kanagawa (JP); Tatsuya Sugawara, Kanagawa (JP); Taewon Kim, Kanagawa (JP)

(72) Inventors: Munehisa Fuda, Kanagawa (JP); Takaya Ochiai, Kanagawa (JP); Kazuki Seto, Kanagawa (JP); Shinji Katsumata, Kanagawa (JP); Tatsuya Sugawara, Kanagawa (JP); Taewon Kim, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/277,903

(22) Filed: May 15, 2014

(65) Prior Publication Data

US 2014/0346728 A1 Nov. 27, 2014

(30) Foreign Application Priority Data

May 21, 2013 (JP) ..... 2013-106851
Mar. 10, 2014 (JP) ..... 2014-045930

(51) Int. Cl.
*B65H 1/08* (2006.01)
*B65H 1/14* (2006.01)

(52) U.S. Cl.
CPC ..... *B65H 1/14* (2013.01); *B65H 2403/42* (2013.01); *B65H 2403/544* (2013.01); *B65H 2403/61* (2013.01); *B65H 2403/72* (2013.01); *B65H 2405/15* (2013.01)

(58) Field of Classification Search
CPC ..... B65H 1/04; B65H 1/266; B65H 1/14; B65H 2801/21
USPC ..... 271/145, 147, 157, 162
See application file for complete search history.

(56) References Cited

U.S. PATENT DOCUMENTS

| | | | | |
|---|---|---|---|---|
| 3,730,516 | A * | 5/1973 | Debray | 271/147 |
| 4,033,578 | A * | 7/1977 | Taylor | B65H 1/08 271/125 |
| 5,794,928 | A * | 8/1998 | Araseki et al. | 271/9.08 |
| 2010/0038846 | A1 * | 2/2010 | Baena et al. | 271/162 |
| 2011/0148027 | A1 | 6/2011 | Fuda | |
| 2011/0187042 | A1 | 8/2011 | Fuda | |
| 2011/0193284 | A1 | 8/2011 | Fuda | |
| 2011/0221119 | A1 | 9/2011 | Fuda | |

FOREIGN PATENT DOCUMENTS

| | | | |
|---|---|---|---|
| JP | 4-23742 | * | 1/1992 |
| JP | 06-156754 | | 6/1994 |
| JP | 8-58989 | * | 3/1996 |
| JP | 2000-247454 | | 9/2000 |
| JP | 4827753 | | 9/2011 |

* cited by examiner

*Primary Examiner* — Thomas Morrison
(74) *Attorney, Agent, or Firm* — Harness, Dickey & Pierce, P.L.C.

(57) ABSTRACT

A sheet feed device that includes a sheet feed tray configured to be enabled to be drawn from a main body of an image forming apparatus; a bottom plate arranged in the sheet feed tray and configured to stack thereon a plurality of sheets; a driving unit configured to move the bottom plate upward; a drive transmitting unit configured to transmit a driving force from a drive source arranged on the main body to the driving unit; and a one-way rotation transmitting unit configured to unidirectionally transmit input from the drive transmitting unit to the driving unit and configured to be arranged on one side of the drive transmitting unit opposite to a side connected to the driving unit.

14 Claims, 5 Drawing Sheets

FIG.9
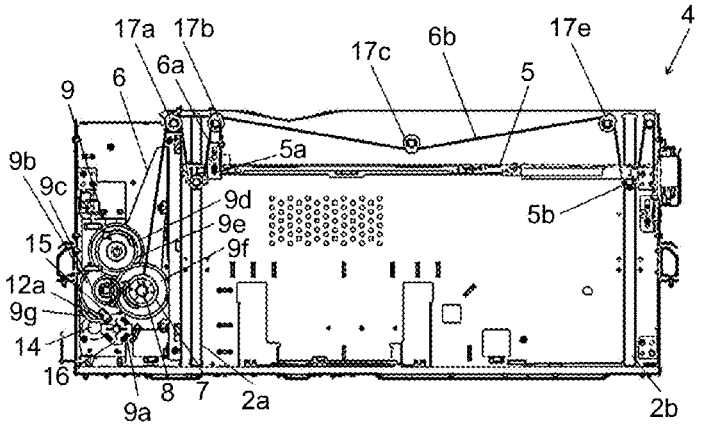
FIG.10
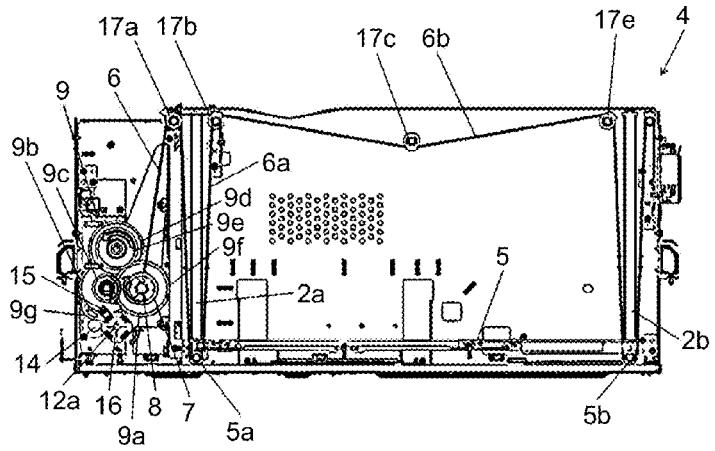
FIG.11
| GEAR | 1 | 2 | 3 | 4 | 5 | 6 |
|---|---|---|---|---|---|---|
| GEAR TEETH | SPUR GEAR | SPUR GEAR | SPUR GEAR | SPUR GEAR | SPUR GEAR | SPUR GEAR |
| NUMBER OF TEETH | 30 | 60 | 30 | 60 | 36 | 48 |
| REDUCTION RATIO | 1.0 | 2.0 | 2.4 | 4.0 | 4.0 | 5.3 |

SHEET FEED DEVICE AND IMAGE FORMING APPARATUS

CROSS-REFERENCE TO RELATED APPLICATIONS

The present application claims priority to and incorporates by reference the entire contents of Japanese Patent Application No. 2013-106851 filed in Japan on May 21, 2013 and Japanese Patent Application No. 2014-045930 filed in Japan on Mar. 10, 2014.

BACKGROUND OF THE INVENTION

1. Field of the Invention

The present invention relates to a sheet feed device including a sheet storage member to store multiple sheets and a unit to move the sheet storage member up and down, and relates to an image forming apparatus including the sheet feed device.

2. Description of the Related Art

In recent years, a large-capacity sheet feed tray capable of storing more than a thousand sheets may be provided in a sheet feed device installed in an image forming apparatus. In such a sheet feed device, a sheet feed member including a roller pair or the like feeds the sheets one by one in order from the topmost sheet to the image forming apparatus.

In this type of the sheet feed device, the sheet feed tray is drawn from the sheet feed device to supply or replace sheets. In this case, the sheet feed tray moves down to the lowermost position due to the weights of stacked sheets. Therefore, it becomes possible to easily supply or replace sheets.

In the sheet feed device configured as described above, if the sheet feed tray is drawn while a large number of sheets are left in the sheet feed tray, a bottom plate of the tray moves downward due to the weights of the sheets before the tray is drawn. Therefore, in some cases, the sheet feed tray may move downward rapidly. To prevent such a situation, there is a known sheet feed device including a buffer mechanism (damper) to prevent the bottom plate of the tray from moving downward rapidly when the sheet feed tray is drawn (see, for example, Japanese Laid-open Patent Publication No. 2008-184300 and Japanese Laid-open Patent Publication No. 6-156754). In the conventional sheet feed device as described above, a predetermined load torque is applied to the bottom plate of the sheet feed tray when the bottom plate moves downward.

In the conventional sheet feed device including the damper as the buffer mechanism, a value of a load resisting force of the damper may be set on the assumption that a small number of sheets are stacked. In this case, if a large number of sheets are stacked, the load resisting force of the damper is so weak that the bottom plate of the tray may move downward rapidly, resulting in noise, such as an impact sound, or damage in the apparatus. In contrast, the value of the load resisting force of the damper may be set on the assumption that a large number of sheets are stacked. In this case, the load resisting force of the damper strongly acts when a small number of sheets are stacked. Therefore, the bottom plate may not move down to the predetermined lowermost position, and a user may need to manually move the bottom plate downward to supply or replace sheets.

Incidentally, while a rotary damper is used as the buffer mechanism in the technologies disclosed in Japanese Laid-open Patent Publication No. 2008-184300 and Japanese Laid-open Patent Publication No. 6-156754, there is also a known structure, in which a direct acting damper including a piston rod/cylinder is directly arranged in an upright manner in the sheet feed tray. Even in this case, the bottom plate may move downward by its own weight when a small number of sheets are stacked. In contrast, when a large number of sheets are stacked, it is possible to prevent the bottom plate from moving downward rapidly by applying a load resisting force to the bottom plate by the direct acting damper.

However, to directly arrange the direct acting damper in an upright manner in the sheet feed tray, it is necessary to increase a buffer stroke. Therefore, it becomes necessary to use a long-shaped damper, and a large space is needed inside the sheet feed tray.

In view of the above circumstances, there is a need to provide a sheet feed device capable of preventing a bottom plate of a tray for stacking multiple sheets from moving downward rapidly at low costs, and to provide an image forming apparatus including the sheet feed device.

SUMMARY OF THE INVENTION

It is an object of the present invention to at least partially solve the problems in the conventional technology.

According to the present invention, there is provided a sheet feed device comprising: a sheet feed tray configured to be enabled to be drawn from a main body of an image forming apparatus; a bottom plate arranged in the sheet feed tray and configured to stack thereon a plurality of sheets; a driving unit configured to move the bottom plate upward; a drive transmitting unit configured to transmit a driving force from a drive source arranged on the main body to the driving unit; and a one-way rotation transmitting unit configured to unidirectionally transmit input from the drive transmitting unit to the driving unit and configured to be arranged on one side of the drive transmitting unit opposite to a side connected to the driving unit.

The present invention also provides an image forming apparatus comprising a sheet feed device, wherein the sheet feed device comprises: a sheet feed tray configured to be enabled to be drawn from a main body of an image forming apparatus; a bottom plate arranged in the sheet feed tray and configured to stack thereon a plurality of sheets; a driving unit configured to move the bottom plate upward; a drive transmitting unit configured to transmit a driving force from a drive source arranged on the main body to the driving unit; and a one-way rotation transmitting unit configured to unidirectionally transmit input from the drive transmitting unit to the driving unit and configured to be arranged on one side of the drive transmitting unit opposite to a side connected to the driving unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 9 is a cross-sectional view for explaining operation of the drive transmitting system of the sheet feed device according to the embodiment of the present invention (a view illustrating rotation directions of the elevation pulleys and the gears when the bottom plate of the sheet feed tray moves downward);

FIG. 10 is a cross-sectional view for explaining operation of the drive transmitting system of the sheet feed device according to the embodiment of the present invention (a view illustrating a state in which the bottom plate of the tray has moved down to the lower limit position); and FIG. 11 is a view illustrating an example of a reduction ratio of the drive transmitting unit illustrated in FIG. 7.

DETAILED DESCRIPTION OF THE PREFERRED EMBODIMENTS

In an embodiment of the present invention, a one-way clutch is not left on a driving unit that is left on a main body of an image forming apparatus when a sheet feed tray is detached. The clutch is detached from the image forming apparatus together with the sheet feed tray. The clutch is provided on a shaft connecting an output side of a gear train, which is arranged on the sheet feed tray to be detached from the main body of the image forming apparatus, and an elevation pulley. The clutch is arranged on an opposite side of a side connected to a drive source of the image forming apparatus. With this configuration, it becomes possible to prevent reverse winding of the elevation pulleys when the gear train of the sheet feed tray continuously rotates by an inertial force.

First Embodiment

An embodiment of the present invention will be explained below with reference to drawings.

Figure 1:
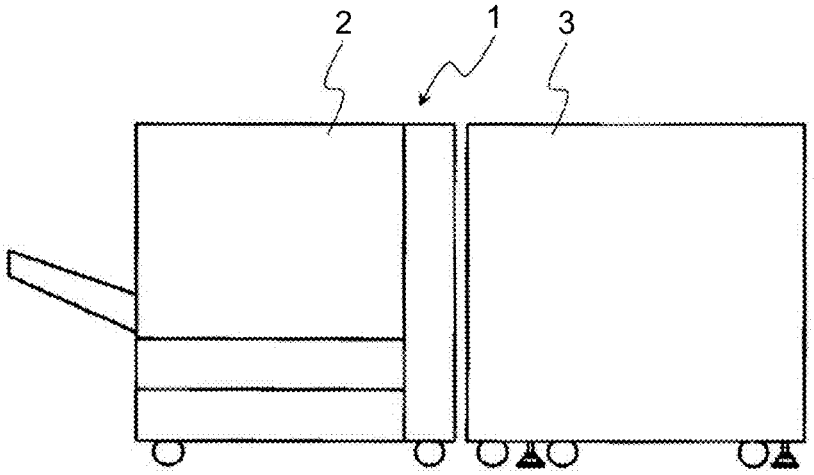
FIG. 1 is a view illustrating a structure of an image forming apparatus including a sheet feed device according to an embodiment of the present invention.

FIG. 1 is a view illustrating a configuration example of an image forming apparatus including a sheet feed device according to an embodiment of the present invention. An image forming apparatus 1 includes a main body 2 of the image forming apparatus and a sheet feed device 3 that is connected to one side of the main body 2 and capable of stacking multiple sheets. In the main body 2, an image forming unit (not illustrated) is provided.

The sheet feed device 3 will be explained below with reference to FIGS. 2 to 6.

Figure 2:
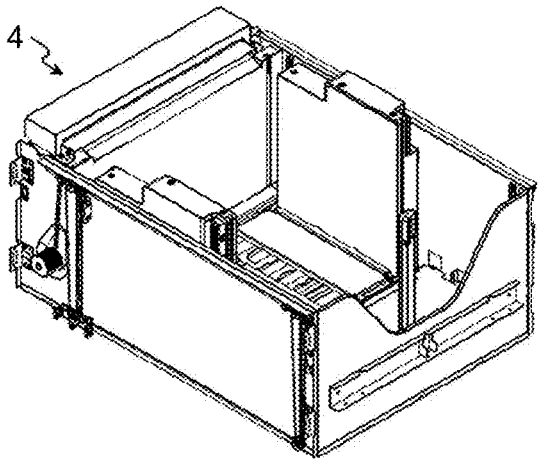
FIG. 2 is a perspective view of a sheet feed tray.

FIG. 2 illustrates a sheet feed tray 4 that can be housed in the sheet feed device 3 in a removable manner. Furthermore, although not illustrated in FIG. 2, a sheet feed unit to feed the topmost sheet among sheets is provided inside the sheet feed device 3. As the sheet feed unit, it may be possible to use an FRR mechanism using rollers or an air-pick mechanism that conveys sheets by using a suction belt. In the embodiment, either type of the sheet feed units may be employed.

Figure 3:
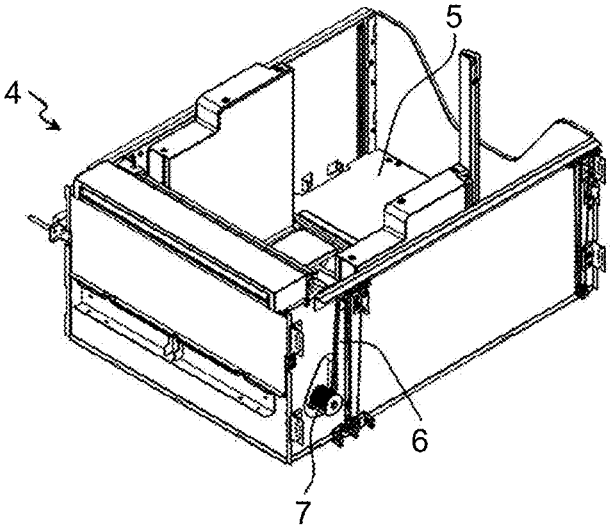
FIG. 3 is a perspective view of the sheet feed tray when viewed from the back side in FIG. 2.

FIG. 3 is a perspective view of the sheet feed tray 4 when viewed from the back side in FIG. 2. A bottom plate 5 in the sheet feed tray is connected to a wire 6 so that the bottom plate 5 can move vertically while keeping the bottom plate 5 horizontal when elevation pulleys 7 rotates to wind up the wire 6. The wire 6 is also arranged on the outside of the sheet feed tray 4 in a symmetrical manner.

Figure 4:
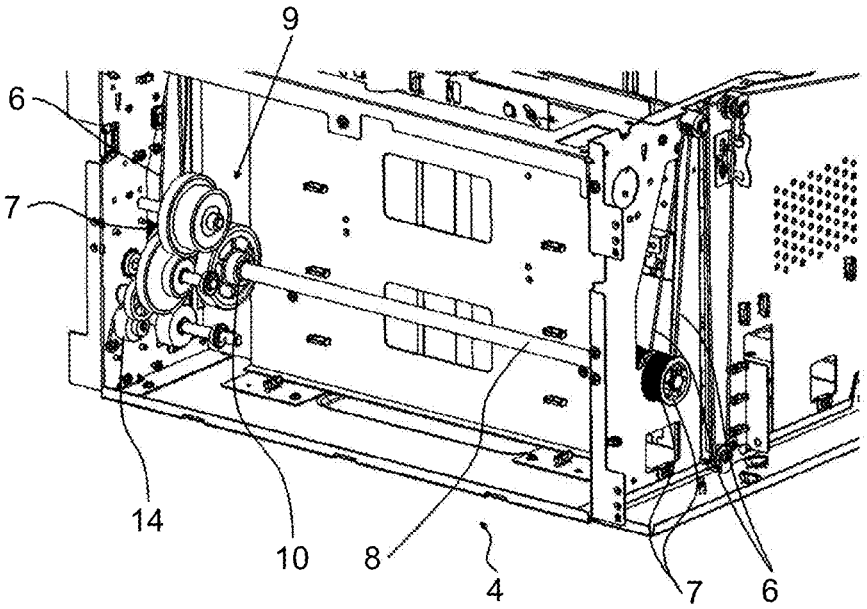
FIG. 4 is a view illustrating an inner structure of the sheet feed tray when viewed in the same direction as in FIG. 3.

FIG. 4 is a view illustrating the inside of the sheet feed tray 4. As illustrated in the drawing, the elevation pulleys 7 are connected to a drive shaft 8, and the elevation pulleys 7 perform winding with rotation of the drive shaft 8. In the drawing, a reference numeral 9 denotes a drive transmitting unit that applies a driving force from a drive source outside the tray and that is connected to the drive shaft 8 via a one-way clutch 10 serving as a one-way rotation transmitting unit. The one-way clutch 10 is arranged in a position on one side (a position serving as an output side) opposite to a side (a driving force input side) connected to a drive source arranged outside the sheet feed tray, that is, arranged on the main body 2 of the image forming apparatus, on the drive shaft 8. Furthermore, the one-way clutch 10 is set in a direction in which it is locked to give a force in an up-down direction.

Figure 5:
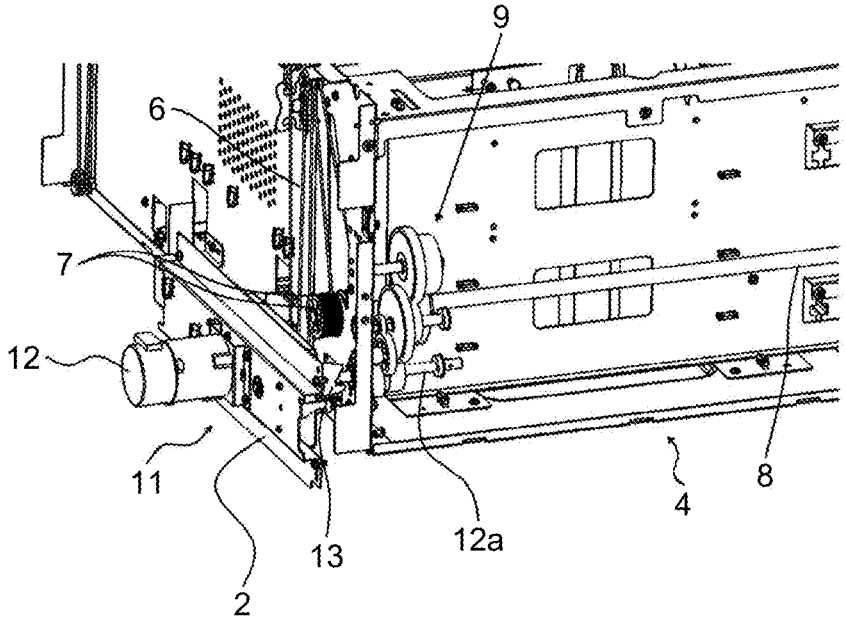
FIG. 5 is a perspective view of the sheet feed tray illustrated in FIG. 4, when viewed from left side.

FIG. 5 is a view illustrating a state in which a drive source 11 arranged on a structural body (outside the tray) of the sheet feed device is connected to the sheet feed tray 4. The drive source 11 includes a motor 12, a gear train (not illustrated), and a coupling 13, and is attached to and detached from a gear train 9 serving as the drive transmitting unit of the sheet feed tray 4 via the coupling 13.

Figure 6:
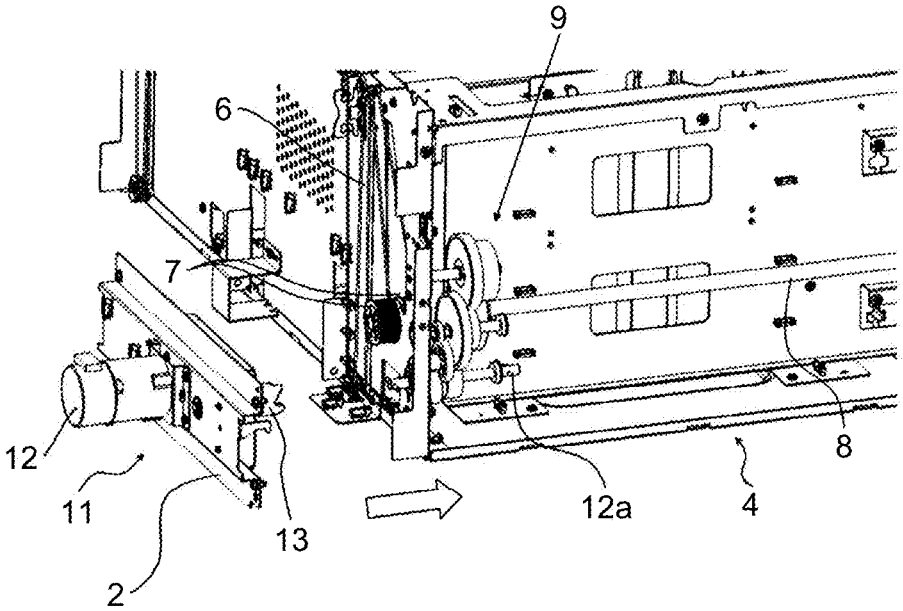
FIG. 6 is a perspective view illustrating a state in which a drive source is detached from a structural body of the sheet feed tray.

FIG. 6 is a perspective view illustrating a state in which the drive source 11 is detached from the structural body of the sheet feed tray 4. As illustrated in the drawing, the drive source 11 is separated from the gear train 9 at a portion of the coupling 13. The coupling 13 includes a driving coupling 13*a* (not illustrated) arranged on the drive source 11 of the main body 2 and a driven coupling 13*b* (not illustrated) arranged on the sheet feed tray 4.

Figure 7:
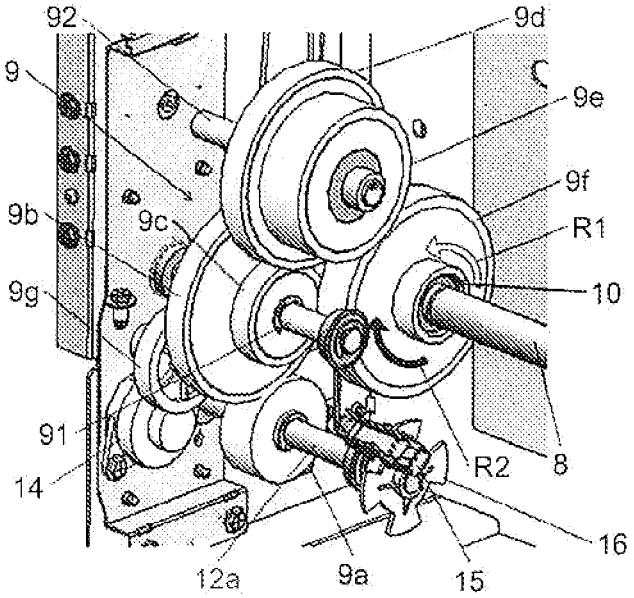
FIG. 7 is an enlarged view of a drive transmitting unit according to the embodiment of the present invention.

FIG. 7 is an enlarged view of the drive transmitting unit illustrated in FIGS. 4 to 6. With reference to FIG. 7, a drive transmitting system of the sheet feed device according to the embodiment of the present invention will be explained in detail below.

The drive transmitting unit 9 according to the present embodiment includes, as illustrated in the drawing, multiple gears 9*a* to 9*f*, an idler gear 9*g*, and multiple rotary shafts 91 and 92. The drive transmitting unit may include an input shaft 12*a* extending from the motor 12 on which the gear 9*a* is mounted and may include the drive shaft 8. Incidentally, the drive shaft 8 also serves as an output shaft of the one-way clutch 10, and the gear 9*f* in the last stage among the gears 9*a* to 9*f* and the one-way clutch 10 are mounted on the same shaft. Furthermore, a braking unit 14 includes a rotary damper, although details are not illustrated in the drawing. Moreover, each of the gears 9*a* to 9*f* is fixed on a side plate or a shaft of the sheet feed tray 4. The gear 9*f* is fixed on the drive shaft 8.

Furthermore, a remaining amount detection sensor 15 and a filler 16 are provided to detect a remaining amount of sheets on the sheet feed tray 4. The remaining amount detection sensor 15 is fixed to the main body 2 of the image forming apparatus (or the sheet feed tray 4), and the filler 16 is attached to the input shaft 12*a* extending from the motor 12 in a rotatable manner.

The one-way clutch 10 allows relative rotation of the gear 9*f* and the drive shaft 8 in the direction of an arrow R1, and restricts relative rotation in the direction of an arrow R2. Therefore, the following operations (1) to (3) are performed when the bottom plate 5 moves up and down. This will be explained below with reference to FIGS. 8 to 10. Incidentally, in FIGS. 8 to 10, the one-way clutch 10 is not illustrated for the simplicity sake.

Figure 8:
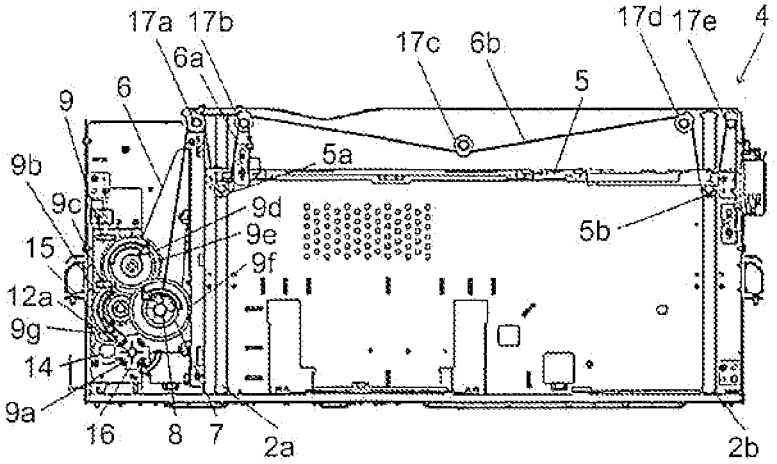
FIG. 8 is a cross-sectional view for explaining operation of a drive transmitting system of the sheet feed device according to the embodiment of the present invention (a view illustrating rotation directions of elevation pulleys and gears when a bottom plate of the sheet feed tray moves upward)

(1) When the bottom plate 5 moves upward, the gears 9*a* to 9*f* start rotating in the directions of arrows illustrated in FIG. 8 from a state in which the drive shaft 8 is stopped. The gear 9*f* in the last stage rotates in the direction of the arrow R1 opposite to the rotation direction (the direction of the arrow R2) of the input shaft 12*a* extending from the motor 12. The one-way clutch 10 is in a locked state, so that the drive shaft 8 and the elevation pulleys 7 also rotate in the directions of the arrows.

(2) A state illustrated in FIG. 9 is maintained from when the bottom plate 5 starts moving downward until the bottom plate 5 moves down to the lower limit position inside the sheet feed tray 4. The gears 9*a* to 9*f*, the elevation pulleys 7, and the drive shaft 8, which have stopped their rotation, rotate in the directions of the arrows illustrated in FIG. 9. The gear 9*f* in the last stage rotates in the direction of the arrow R2 opposite to the rotation direction (the direction of the arrow R1) of the input shaft 12*a* extending from the motor 12.

(3) After the bottom plate 5 moves down to the lower limit position inside the sheet feed tray 4 as illustrated in FIG. 10, the gears 9*a* to 9*f* are driven by inertia. When the bottom plate 5 moves down to the lower limit position, the rotation of the elevation pulleys 7 and the drive shaft 8 is stopped, but the gears 9*a* to 9*f* continues to rotate in the directions of the arrows illustrated in FIG. 10 by inertia. In this state, the one-way clutch 10 is released, so that the elevation pulleys 7 and the drive shaft 8 do not rotate. Therefore, it becomes possible to prevent the wire 6 from being wound in a reverse direction.

As for the remaining amount of sheets, the remaining amount detection sensor 15 detects the amount of elevation of the bottom plate 5 based on the rotation speed of the filler 16, and indirectly calculates the remaining amount of sheets based on the amount of elevation of the bottom plate 5. A value of the remaining amount of sheets detected by the remaining amount detection sensor 15 as described above is displayed, as a remaining amount display, on a display panel of an operating unit of the image forming apparatus for example. It may be possible to change the output of air for separating the topmost sheet from other sheets or change the elevation amount of the bottom plate 5, depending on the value of the remaining amount of sheets.

The idler gear 9*g* engages with a gear (not illustrated) mounted on the rotary shaft 91 behind the gear 9*b* and with the rotary damper of the braking unit 14. A predetermined braking force (torque) is applied to the rotary damper such that the braking force slightly increases with an increase in the acceleration of the bottom plate 5 when the bottom plate 5 moves downward.

FIG. 11 illustrates an example of a reduction ratio of the drive transmitting unit illustrated in FIG. 7. Numbers (1 to 6) in the first row correspond to symbols a to f of the gears 9*a* to 9*f* illustrated in FIGS. 7 to 10, respectively. Specifically, the number 1 indicates the gear 9*a*, the number 6 indicates the gear 9*f*, and the same applies to the other gears.

Furthermore, numerals 1.0, 2.0, 2.4, 4.0, 4.0, and 5.3 in a field "reduction ratio" indicate reduction ratios of the gears identified by the numbers (1 to 6) in the first row, respectively. As for the reduction ratio of the gear train, the reduction ratios of the first gear 9*a* to the sixth gear 9*f* are 1.0, 2.0, 2.4, 4.0, 4.0, and 5.3, respectively, and the reduction ratio of the gear train is obtained such that 5.3/1.0=5.3.

FIG. 8 to FIG. 10 will be explained below, and problems with a conventional technology (in which a one-way clutch is not provided and only a gear train and a braking unit serving as a drive transmitting system is provided on a sheet feed tray) will be explained for comparison.

FIG. 8 is a cross-sectional view for explaining operation of the drive transmitting system of the sheet feed device according to the embodiment of the present invention. Specifically, FIG. 8 illustrates rotation directions of the elevation pulleys 7 and various gears when the bottom plate 5 moves upward. In the example illustrated in the drawing, a system that moves the bottom plate 5 up and down by using the wire 6 is employed; however, the present invention is not limited to this example and any well-known elevator system may be employed.

In the state illustrated in FIG. 8, although not illustrated in the drawing, the sheet feed tray 4 is attached to the main body 2. Therefore, although not illustrated in the drawing, the driving coupling 13*a* of the drive source 11 of the main body 2 and the driven coupling 13*b* of the sheet feed tray 4 are connected.

Specifically, the wire 6 includes two wires 6*a* and 6*b*. As illustrated in FIG. 4, the two elevation pulleys 7 are provided on each of left and right end portions of the drive shaft 8, that is, a total of four elevation pulleys are provided. The pulleys are provided for the first wire 6*a* and the second wire 6*b*. To wind the wires 6*a* and 6*b*, pulleys 17*a* to 17*e* are provided on the main body 2. Furthermore, reference numerals 5*a* and 5*b* denote pulleys serving as guides to move the bottom plate 5 up and down. Hereinafter, the pulley 5*a* may be referred to as a bottom plate front pulley, and the pulley 5*b* may be referred to as a bottom plate rear pulley. The pulleys 5*a* and 5*b* are fitted to guide groove openings 2*a* and 2*b*, each extending in a vertical direction on a side plate of the main body 2, and move along the guide groove openings 2*a* and 2*b*, respectively. Therefore, the bottom plate 5 is enabled to easily move up and down while being maintained horizontally.

FIG. 9 is a view illustrating the rotation directions of the elevation pulleys and the gears when the bottom plate 5 of the sheet feed device moves downward in the embodiment of the present invention. FIG. 10 is a view illustrating a state in which the bottom plate of the tray moves down to the lower limit position. In the states illustrated in FIG. 9 and FIG. 10, the sheet feed tray 4 is drawn from the main body 2. In this state, the not-illustrated driving coupling 13*a* of the main body 2 and the not-illustrated driven coupling 13*b* of the sheet feed tray 4 are disconnected, and the driven coupling 13*b* of the sheet feed tray 4 is enabled to freely rotate.

The operation in the states illustrated in FIG. 9 and FIG. 10 will be explained below. The explanation includes explanation of a problem that occurs when the one-way clutch 10 is not provided.

(1) When the sheet feed tray 4 is drawn from the main body 2, engagement between the not-illustrated driving coupling 13*a* arranged on the main body 2 of the image forming apparatus and the not-illustrated driven coupling 13*b* arranged on the sheet feed tray 4 is released.

(2) Accordingly, the bottom plate 5 starts moving downward by its own weight (the state in FIG. 9). The falling speed of the bottom plate 5 gradually increases, but is restricted to a predetermined speed by the action of the rotary damper of the braking unit 14.

(3) The bottom plate 5 moves downward rapidly at a predetermined speed (a predetermined speed by the action of the braking unit 14) by inertia of the downward movement. In this case, the bottom plate may move downward so rapidly that it may hit against the bottom surface of the sheet feed tray 4 (the lower limit position of the bottom plate 5 moving downward) (FIG. 10).

(4) The gears 9*a* to 9*d* continue to rotate in a downward direction by inertia (the directions of the arrows indicating rotation in FIG. 10).

(5) The bottom plate 5 stops at the lower limit position of the sheet feed tray 4, so that the rotation of the drive shaft 8 is stopped.

(6) Even though the drive shaft 8 is stopped, the gears 9*a* to 9*d* continue to rotate. Therefore, the drive shaft 8 continues to rotate in the direction of the arrow illustrated in FIG. 10.

(7) If the drive shaft 8 rotates, the elevation pulleys 7 rotates in the direction of the arrow illustrated in FIG. 10, so that the wire 6 is wound in a reverse direction. Due to the reversely-wounded state, large loads are applied to mounting portions of the elevation pulleys 7 and the wire 6. The mounting portions of the elevation pulleys 7 and the wire 6 are not designed to have enough strengths to resist the reversely-wounded state. Therefore, if the reversely-wounded state occurs frequently, the mounting portions of the elevation pulleys 7 and the wire 6 may be damaged.

(8) Furthermore, if the elevation pulleys 7 further continues to rotate in the direction of arrow in FIG. 10 while the wire 6 are reversely wound, the bottom plate 5 stopped at the lower limit position in the sheet feed tray 4 moves upward again, and when the rotation of the elevation pulleys 7 is stopped, the bottom plate 5 moves downward and hit against the bottom surface of the sheet feed tray 4 resulting in a large impact sound. Furthermore, the upward and downward movement as described above may be repeated.

Specifically, in the conventional sheet feed tray 4, when the sheet feed tray 4 is drawn after the bottom plate 5 has moved up, the bottom plate 5 may move downward rapidly by its own weight or the weights of sheets, and, after the bottom plate 5 reaches the lowermost position, the gears 9*a* to 9*f* continue to rotate by the inertial force of the downward movement. Therefore, the drive shaft 8 rotates so as to wind up the wire 6 in a reverse direction, and an extra load is applied to the elevation pulleys 7 and the wire 6, resulting in damage.

To cope with this, in the sheet feed tray 4 according to the present embodiment, the drive shaft 8 is connected to the gear 9*f* via the one-way clutch 10 as described above. Therefore, after the bottom plate 5 reaches and stops at the lowermost position, the inertial force of the gear train 9 is used to cause the one-way clutch 10 to spin around. Therefore, it becomes possible to prevent the elevation pulleys 7 and the wire 6 from being damaged.

Second Embodiment

The gear train 9 is configured to transmit, to the drive shaft 8, a force to decelerate the rotation speed of the drive source 11 to move the sheet feed tray 5 up and down as described above. The gear train 9 includes a combination of gears with the reduction ratios of 5 or greater. Specifically, the reduction ratio is set to be equal to or grater than a value such that the output of the drive source 11 becomes five times greater than the output of the drive shaft 8.

When the sheet feed tray 4 is drawn after the bottom plate 5 has moved upward, the bottom plate 5 moves downward rapidly by its own weight or the weights of sheets. The force for downward movement needs an inertial force that causes the gears of the gear train 9 to move. The inertial force prevents the bottom plate 5 from moving downward rapidly. If the reduction ratio is set to 5 or greater, the rotation speed of each of the gears of the gear train 9 is increased by the reduction ratio when the bottom plate 5 rapidly moves downward, so that each of the gears rotates at the increased speed and the inertial force serving as the braking force increases proportionally. Therefore, it becomes possible to prevent an impact sound and damage of the bottom plate due to the rapid downward movement of the bottom plate 5.

Third Embodiment

In the embodiments as described above, examples have been explained in which the rotary damper is used as the braking unit 14. However, other devices or elements, such as torque limiters, may be used. If the braking unit 14 is provided in the gear train 9 as in the configuration as described above, the braking unit 14 only receives a force of a reduced torque due to the increased speed of the gear train. Therefore, it becomes possible to reduce a torque needed for the braking member. As a result, it becomes possible to employ the braking unit 14 at low costs, enabling to reduce overall costs.

Fourth Embodiment

The sheet feed device of the above embodiments can be configured at low costs. Therefore, an image forming apparatus including the sheet feed device can prevent the bottom plate with a large number of stacked sheets from rapidly moving downward. Furthermore, the image forming apparatus can be provided at low costs.

The present invention is not limited to the embodiments as described above, and may be embodied in various forms by person skilled in the art within the scope of technical ideas of the present invention.

According to an embodiment of the present invention, it becomes possible to prevent a bottom plate for stacking multiple sheets from rapidly moving downward and prevent related components for moving the bottom plate up and down from being damaged, at low costs. Therefore, it becomes possible to provide a sheet feed device and an image forming apparatus including the sheet device at low costs.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feed device comprising:

a sheet feed tray configured to be enabled to be drawn from the sheet feeding device;

a bottom plate arranged in the sheet feed tray and configured to stack thereon a plurality of sheets;

a driving unit comprising a drive shaft and a wire winding pulley on one end of the drive shaft, the driving unit being arranged on the sheet feed tray and configured to move the bottom plate upward;

a drive transmitting unit arranged on the sheet feed tray and configured to transmit a driving force from a drive source arranged outside of the sheet feed tray on the sheet feed device to the driving unit on the sheet feed tray; and a one-way rotation transmitting unit on an opposite end of the drive shaft and arranged in the sheet feed tray, the one-way rotation transmitting unit being configured to unidirectionally transmit the driving force to the driving unit, wherein the drive transmitting unit includes a gear train, the one-way rotation transmitting unit is arranged on an output side of the gear train connected to the driving unit, and the gear train of the drive transmitting unit includes gears having a reduction ratio of 5 or greater.

2. The sheet feed device according to claim 1, wherein the drive transmitting unit includes a braking unit.

3. The sheet feed device according to claim 2, wherein the braking unit is arranged close to the drive source relative to the one-way rotation transmitting unit, and the drive source and the braking unit are connected to each other via a gear that transmits the driving force of the drive source.

4. The sheet feed device according to claim 1, wherein the driving unit is configured to move the bottom plate upward while retaining the bottom plate in a horizontal position.

5. The sheet feed device according to claim 1, wherein the driving unit is configured to move the entire bottom plate upward.

6. The sheet feed device according to claim 1, wherein the driving unit is arranged above the bottom plate when the bottom plate is in a lowermost position in the sheet feed tray.

7. The sheet feed device according to claim 1, wherein the driving unit is arranged on a vertical sidewall of the sheet feed tray.

8. The sheet feed device according to claim 1, wherein the entire drive transmitting unit is arranged inside of the sheet feed tray.

9. The sheet feed device according to claim 1, wherein the entire drive transmitting unit is arranged downstream of the entire bottom plate in a paper feed direction.

10. An image forming apparatus comprising a sheet feed device, wherein the sheet feed device comprises:

a sheet feed tray configured to be enabled to be drawn from a main body of an image forming apparatus;

a bottom plate arranged in the sheet feed tray and configured to stack thereon a plurality of sheets;

a driving unit comprising a drive shaft and a wire winding pulley on one end of the drive shaft, the driving unit being arranged on the sheet feed tray and configured to move the bottom plate upward;

a drive transmitting unit arranged on the sheet feed tray and configured to transmit a driving force from a drive source arranged outside of the sheet feed tray on the main body to the driving unit on the sheet feed tray; and a one-way rotation transmitting unit on an opposite end of the drive shaft and arranged inside of the sheet feed tray, the one-way rotation transmitting unit being configured to unidirectionally transmit the driving force to the driving unit, wherein the drive transmitting unit includes a gear train, the one-way rotation transmitting unit is arranged on an output side of the gear train connected to the driving unit, and the gear train of the drive transmitting unit includes gears having a reduction ratio of 5 or greater.

11. The sheet feed device according to claim 10, wherein the driving unit is arranged above the bottom plate when the bottom plate is in a lowermost position in the sheet feed tray.

12. The sheet feed device according to claim 10, wherein the driving unit is arranged on a vertical sidewall of the sheet feed tray.

13. The sheet feed device according to claim 10, wherein the entire drive transmitting unit is arranged inside of the sheet feed tray.

14. The sheet feed device according to claim 10, wherein the entire drive transmitting unit is arranged downstream of the entire bottom plate in a paper feed direction.

* * * * *